US009417548B2

(12) United States Patent
Kojima

(10) Patent No.: US 9,417,548 B2
(45) Date of Patent: Aug. 16, 2016

(54) IMAGE FORMING APPARATUS IN WHICH CHARGING CURRENT CHANGES CORRESPONDING TO VOLTAGE RISE DURING TRANSFER VOLTAGE DETERMINATION

(71) Applicant: CANON KABUSHIKI KAISHA, Tokyo (JP)
(72) Inventor: Etsuji Kojima, Kashiwa (JP)
(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/851,124

(22) Filed: Sep. 11, 2015

(65) Prior Publication Data

US 2016/0077456 A1 Mar. 17, 2016

(30) Foreign Application Priority Data

Sep. 12, 2014 (JP) ..... 2014-186405

(51) Int. Cl.
*G03G 15/00* (2006.01)
*G03G 15/02* (2006.01)
*G03G 15/16* (2006.01)

(52) U.S. Cl.
CPC ..... *G03G 15/0266* (2013.01); *G03G 15/1675* (2013.01)

(58) Field of Classification Search
CPC ..... G03G 15/0266; G03G 15/1645; G03G 15/1675
See application file for complete search history.

(56) References Cited

U.S. PATENT DOCUMENTS 5,296,903 A * 3/1994 Suzuki ..... G03G 15/1645 399/66
6,278,103 B1 8/2001 Takami
2008/0118259 A1 5/2008 Yamada
2011/0110677 A1* 5/2011 Uehara ..... G03G 15/0266 399/50
2012/0201553 A1 8/2012 Hano
2013/0259502 A1* 10/2013 Motomura ..... G03G 15/1645 399/50
2013/0279928 A1* 10/2013 Sakato ..... G03G 15/0266 399/50
2014/0212158 A1* 7/2014 Adachi ..... G03G 21/0064 399/44

FOREIGN PATENT DOCUMENTS

| | | | |
|---|---|---|---|
| JP | 3-267972 | H3 | 11/1991 |
| JP | 6-175514 | H6 | 6/1994 |
| JP | 8-146787 | H8 | 6/1996 |
| JP | 2001-125338 | | 5/2001 |
| JP | 2007232881 | | 9/2007 |
| JP | 2008008991 | | 1/2008 |

* cited by examiner

*Primary Examiner* — David Gray
*Assistant Examiner* — Trevor J Bervik
(74) *Attorney, Agent, or Firm* — Fitzpatrick, Cella, Harper & Scinto

(57) ABSTRACT

An image forming apparatus includes a photosensitive member, a charging member, a charging voltage source, an exposure device, a developing device, a transfer member, a transfer voltage source, a voltage detecting portion, a current detecting portion, and an executing portion. In a test mode, the executing portion gradually changes a value of a current caused to flow through the transfer member from zero to a predetermined target transfer current and sets the current caused to flow through the transfer member as the predetermined target transfer current, and then gradually changes a current caused to flow through the charging member from zero to an obtained charging current when a region of the photosensitive member subsequently passes through the charging portion and sets the current caused to flow through the charging member when a region of the photosensitive member subsequently passes through the charging portion as the obtained charging current.

5 Claims, 5 Drawing Sheets

IMAGE FORMING APPARATUS IN WHICH CHARGING CURRENT CHANGES CORRESPONDING TO VOLTAGE RISE DURING TRANSFER VOLTAGE DETERMINATION

FIELD OF THE INVENTION AND RELATED ART

The present invention relates to an image forming apparatus, of an electrophotographic type, such as a copying machine, a printer or a facsimile machine.

In recent years, in the image forming apparatus of the electrophotographic type, a method in which a charging member of a roller type and a blade type is brought near to or into contact with an electrophotographic photosensitive member to electrically charge the photosensitive member has been widely used. This method is further classified roughly into two (first and second) methods. The first method is an "AC charging type" in which as a charging voltage, a superposed voltage in the form of a DC voltage biased with an AC voltage is applied to the charging member, and the second method is a "DC charging type" in which as the charging voltage, only the DC voltage is applied to the charging member.

The DC charging type has advantages such that a lifetime of the photosensitive member is long and an amount of generation of an electric discharge product can be suppressed. This is because compared with the AC charging type, an amount of electric discharge to the photosensitive member is small in the DC charging type. However, the DC charging type is inferior to the AC charging type in uniformity (charging uniformity) of a surface potential of the photosensitive member after the charging process.

Specifically, in the AC charging type, by applying the charging voltage in the form of the DC voltage biased with the AC voltage having a value of a peak-to-peak voltage exceeding two times an electric discharge start voltage during application of the DC voltage, the photosensitive member can be electrically charged to a toner of the DC voltage. On the other hand, in the DC charging type, the photosensitive member cannot be electrically charged to the potential of the DC voltage. This is attributable to the following reason. FIG. 7 shows an example of a relationship between an applied voltage and a potential of the photosensitive member (drum) in the DC charging type. As shown in FIG. 7, in order to charge the photosensitive member by the DC charging type, there is a need to apply a DC voltage exceeding an electric discharge start voltage between the photosensitive member and the charging member. For that reason, in the DC charging type, the surface potential of the photosensitive member is lower than the applied voltage.

On the other hand, in this image forming apparatus of the electrophotographic type, as a type in which a toner image is transferred from the photosensitive member onto a toner image receiving member, a type in which a transfer voltage is applied to a transfer member, of a roller type or a blade type, disposed opposed to the photosensitive member to electrostatically transfer the toner image has been widely used. For example, an image forming apparatus of an intermediary transfer type includes, as an intermediary transfer member as the toner image receiving member, an intermediary transfer belt constituted by an endless belt. The intermediary transfer belt is sandwiched between the photosensitive member and the transfer member, so that a transfer portion (transfer nip) is formed at a contact portion between the intermediary transfer belt and the photosensitive member. Then, the toner image is transferred from the photosensitive member onto the intermediary transfer belt by the transfer voltage applied to the transfer member.

In such an image forming apparatus, it has been known that electrical resistances of the transfer member and the intermediary transfer belt fluctuate depending on ambient temperature and humidity or by repetitive use. By the fluctuation of these electrical resistances, a value of an optimum transfer voltage for transferring the toner image varies. When as the transfer voltage, a voltage having a value lower than the value of the optimum transfer voltage is applied, there is a liability that a transfer property lowers. Particularly, in a color image forming apparatus, there is a liability that color stability is impaired by the lowering in transfer property. When as the transfer voltage, a voltage having a value higher than the value of the optimum transfer voltage is applied, there is a liability that abnormal electric discharge generates at the transfer portion and thus first defect due to the electric discharge generates.

Therefore, in Japanese Laid-Open Patent Application 2001-125338, an adjusting operation for adjusting a transfer voltage value to an optimum voltage value is performed. This adjusting operation will be briefly described. Before image formation is started, a voltage subjected to constant current control is applied to a transfer member, and an output voltage value at that time is obtained. From information on this voltage value and a current value, an electric resistance from the transfer member to a photosensitive member is obtained, and depending on a result thereof, a value of a transfer voltage to be applied to the transfer member during image formation effected thereafter is adjusted. Such an adjusting operation is also called ATVC (active transfer voltage control).

However, as described above, the DC charging type is inferior to the AC charging type in charging uniformity. For that reason, the potential of the photosensitive member after the charging process is liable to be influenced by the voltage applied to the transfer member. The charge potential of the photosensitive member varies depending on the surface potential of the photosensitive member after passed through the transfer portion in some cases, so that a time required for causing the surface potential of the photosensitive member to converge to a target charge potential.

As described above, in the DC charging type, when the voltage applied to the transfer member is changed in the adjusting operation of the transfer voltage, the surface potential (pre-charge potential) of the photosensitive member after passed through the transfer portion fluctuates, so that also the surface potential (charge potential) of the photosensitive member after the charging process fluctuates in some cases.

Here, in order to adjust the transfer voltage with accuracy, it is desired that the transfer voltage during image formation is determined from the information on the value of the voltage applied to the transfer member when a region in which the surface potential of the photosensitive member is stable passes through the transfer portion and on the current value. For that reason, in order to adjust the transfer voltage with accuracy, there is a need to wait until the surface potential of the photosensitive member is stabilized, and correspondingly much time is required. For example, in order to stabilize the surface potential of the photosensitive member in a region in which a fluctuating transfer current flowed, after the charging process is performed plural times by rotating the photosensitive member plural times, the information on the values of the voltage and current which are applied to the transfer member is obtained in some cases. For that reason, a time required for effecting the ATVC becomes long in some cases.

SUMMARY OF THE INVENTION

According to an aspect of the present invention, there is provided an image forming apparatus comprising: a rotatable photosensitive member; a charging member for electrically charging a surface of the photosensitive member; a charging voltage source for applying a charging voltage which is a DC voltage to the charging member; an exposure device for exposing the charged surface of the photosensitive member to light to form an electrostatic image; a developing device for visualizing the electrostatic image as a toner image by supplying a toner to the photosensitive member; a transfer member for transferring the toner image from the photosensitive member onto a toner image receiving member at a transfer portion; a transfer voltage source for applying a transfer voltage to the transfer member; a first detecting portion for detecting a voltage of the transfer voltage source when the transfer voltage source causes a current to flow through the transfer member; a second detecting portion for detecting a current flowing through the charging member when the charging voltage source applies a voltage to the charging member; and an executing portion for executing an operation in an obtaining mode and an operation in a test mode, wherein in the operation in the obtaining mode, the current detected by the second detecting portion during passing of a region of the photosensitive member through the charging portion after the region of the photosensitive member passed through the charging portion and the transfer portion when a predetermined charging voltage is applied to the charging member and a predetermined transfer current is caused to flow through the transfer member is obtained as an obtained charging current in a period preceding to a transfer period in which the toner image is transferred at the transfer portion, and wherein in the operation in the test mode, in a detecting period after the operation in the obtaining mode and in the period preceding to the transfer period, a voltage applied to the transfer member in the transfer period is set on the basis of a detection result of the first detecting portion when the transfer voltage source causes the predetermined transfer current to flow through the transfer member, wherein in the operation in the test mode, the executing portion gradually changes a value of the current caused to flow through the transfer member from zero to a predetermined target transfer current in a rising period preceding to the detecting period and sets the current caused to flow through the transfer member as the predetermined target transfer current in the detecting period and, and then gradually changes the current caused to flow through the charging member from zero to the obtained charging current when a region of the photosensitive member positioned at the transfer portion in the rising period subsequently passes through the charging portion and sets the current caused to flow through the charging member when a region of the photosensitive member positioned at the transfer portion in the detecting period subsequently passes through the charging portion as the obtained charging current.

These and other objects, features and advantages of the present invention will become more apparent upon a consideration of the following description of the preferred embodiments of the present invention taken in conjunction with the accompanying drawings.

DESCRIPTION OF THE EMBODIMENTS

An image forming apparatus according to the present invention will be described with reference to the drawings.

Embodiment 1

1. General Structure and Operation of Image Forming Apparatus

Figure 1:
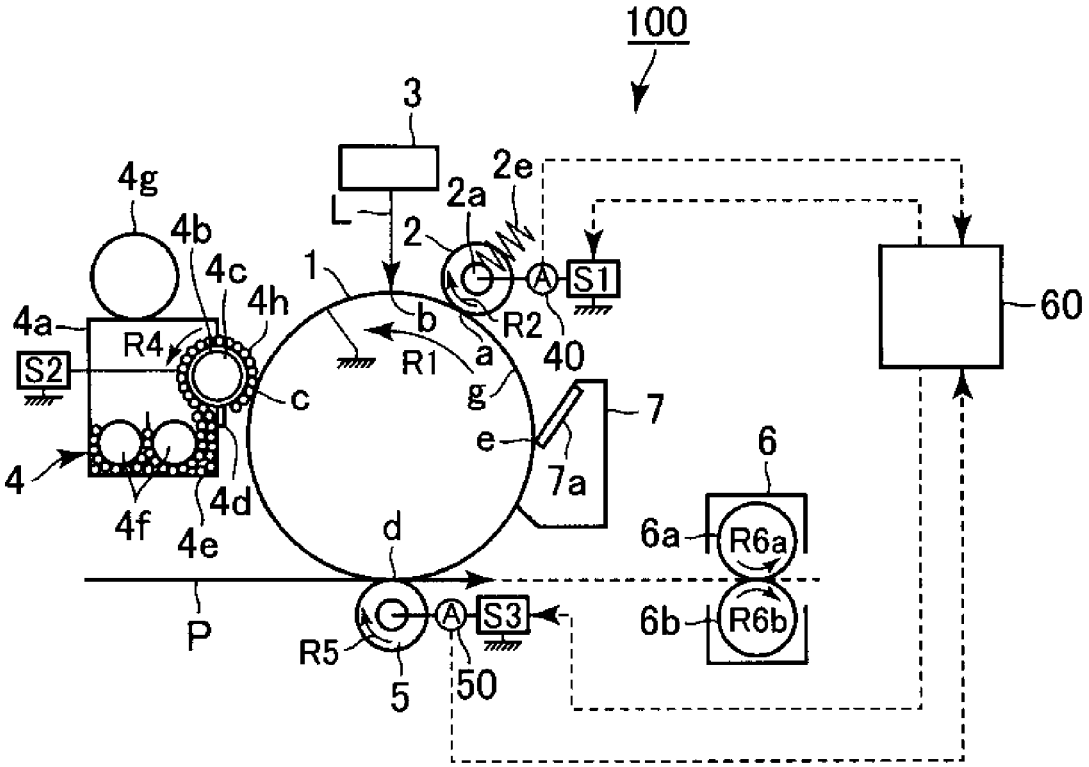
FIG. 1 is a schematic sectional view of an image forming apparatus.

FIG. 1 is a schematic sectional view of an image forming apparatus 100 in this embodiment according to the present invention.

The image forming apparatus 100 in this embodiment is a laser beam printer which uses a transfer type electrophotographic process, a contact charging type, a reverse development type, and an A3 size as a maximum sheet passing size.

The image forming apparatus 100 includes, a photosensitive drum 1 which is a rotatable drum-shaped (cylindrical) electrophotographic photosensitive member as an image bearing member. At a periphery of the photosensitive drum 1, along a rotational direction of the photosensitive drum 1, the following process means are provided. First, a charging roller 2 which is a roller-shaped contact charging member as a charging means is disposed. Next, an exposure device 3 as an exposure means is disposed. Next, a developing device 4 as a developing means is disposed. Next, a transfer roller 5 which is a roller-shaped contact transfer member as a transfer means. Next, a cleaning device 7 as a cleaning means is disposed.

Figure 2:
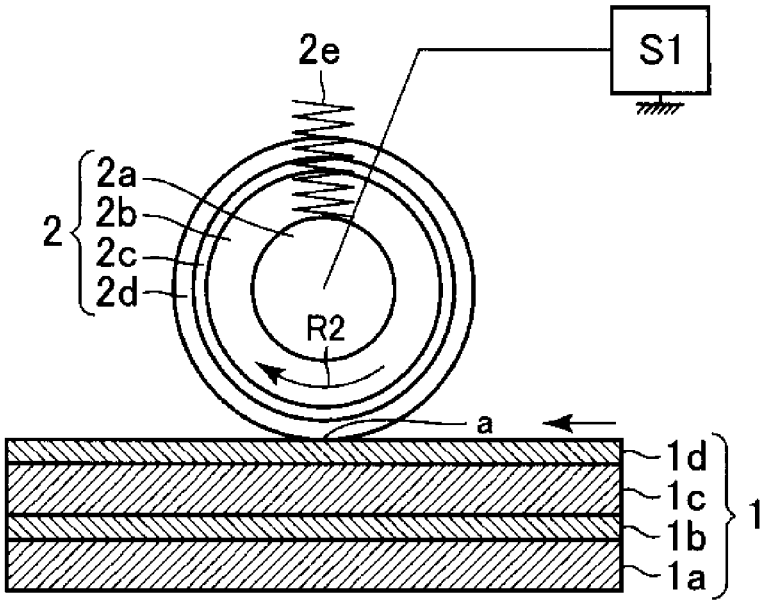
FIG. 2 is a schematic sectional view showing a laser structure of a photosensitive drum and a charging roller.

The photosensitive drum 1 is a negatively chargeable organic photoconductor (OPC) of 30 mm in outer diameter and 330 mm in length with respect to a longitudinal direction (rotational axis direction). The photosensitive drum 1 is rotationally driven at a process speed (peripheral speed) of 135 mm/sec in an arrow R1 direction in FIG. 1 by drive of a driving device (not shown). The photosensitive drum 1 is constituted, as shown in FIG. 2, by applying, onto a surface of an aluminum cylinder (electroconductive drum support) 1*a*, three layers consisting of an undercoat layer 1*b* for suppressing interference with light and for improving an adhesive property with an upper layer, a photo-charge generating layer 1*c* and a charge transporting layer 1*d* in this order.

The charging roller 2 is disposed in contact with the surface of the photosensitive drum 1.

The charging roller 2 is rotatably held by shaft-supporting (bearing) members (not shown) at both end portions of its core metal (core material) 2*a* with respect to a longitudinal direction (rotational axis direction) and is urged toward a center direction of the photosensitive drum 1 by an urging spring 2*e* as an urging means. As a result, the charging roller 2 is press-contacted to the photosensitive drum 1 with a predetermined urging force. The charging roller 2 is rotationally driven in a direction indicated by an arrow R2 (clockwise direction) in FIG. 2 by the rotational drive of the photosensitive drum 1.

To the charging roller 2, from a charging voltage source S1 as a charging voltage applying means, a charging voltage (charging bias) is applied under a predetermined condition. The charging voltage is applied to the charging roller 2 through the core metal 2*a*. As a result, a peripheral surface the photosensitive drum 1 is electrically charged to a predetermined polarity (negative in this embodiment) and a predetermined potential (charging process). A contact portion between the photosensitive drum 1 and the charging roller 2 is a charging nip a. With respect to the rotational direction of the photosensitive drum 1, a position where the photosensitive drum 1 is charged by the charging roller 2 is a charging portion (charging position). The charging roller 2 charges the surface of the photosensitive drum 1 by electric discharge generating in at least one of gaps, between the charging roller 2 and the photosensitive drum 1, upstream and downstream of the charging nip a with respect to the rotational direction of the photosensitive drum 1. In this embodiment, for easy understanding, it is deemed that the surface charging process of the photosensitive drum 1 is performed at the charging nip, and thus the charging nip is described as the charging portion a in some cases. A position g in FIG. 1 is a position immediately in front of the charging portion a with respect to the rotational direction of the photosensitive drum 1. In this embodiment, to the charging roller 2, as the charging voltage, only the DC voltage (DC component) is applied. In this embodiment, during image formation, the peripheral surface of the photosensitive drum 1 is uniformly charged to a charge potential (dark portion potential) of −700 V.

The charging roller 2 has a length of 320 mm with respect to its longitudinal direction. As shown in FIG. 2, the charging roller 2 has, around the core metal (supporting member) 2*a*, three-layer structure consisting of a lower layer 2*b*, an intermediary layer 2*c*, and a surface layer 2*d* which are successively laminated in this order. The lower layer 2*b* is a foam sponge layer for decreasing charging noise, and the surface layer 2*d* is a protective layer provided for preventing an occurrence of leakage even when a defect such as a pin hole generates on the photosensitive drum 1.

More specifically, the charging roller 2 in this embodiment has the following specification.

Core metal 2*a*: stainless steel rod with a diameter of 6 mm

Lower layer 2*b*: carbon-dispersed foam EPDM (specific gravity: 0.5 g/cm$^3$, volume resistivity: $10^2$-$10^9$ ohm·cm, layer thickness: 3.0 mm)

Intermediary layer 2*c*: carbon-dispersed NBR rubber (volume resistivity: $10^2$-$10^5$ ohm·cm, layer thickness: 700 μm)

Surface layer 2*d*: fluorinated "Torejin" resin in which tin oxide and carbon particles are disposed (volume resistivity: $10^7$-$10^{10}$ ohm·cm, surface roughness (JIS ten-point average surface roughness Ra): 1.5 μm, layer thickness: 10 μm)

In this embodiment, between the charging voltage source S1 and the charging roller 2, a charging current measuring circuit ("charging ammeter") 40 as a current detecting means is provided. As a result, the charging ammeter 40 can detect a value of a DC current flowing through the charging roller 2 when the charging voltage source S1 applies the DC voltage to the charging roller 2. The charging ammeter 40 may only be required to measure the DC current value between the photosensitive drum 1 and the charging roller 2 and therefore may also be provided between the develop 1 and the ground. In this embodiment, the charging voltage source S1 is constituted so that it can output a constant voltage having a voltage value set by control of a controller 60. The controller 60 changes a set value of the output of the charging voltage source S1 so that the current value detected by the charging ammeter 40 is a predetermined value, whereby a voltage supplying a predetermined current can be applied from the charging voltage source S1 to the charging roller 2. The controller 60 can obtain pieces of information on the voltage value and the current value from the set value of the output of the charging voltage source S1 and a detection result of the charging ammeter 40 at this time, respectively.

The exposure device 3 is a laser beam scanner using a semiconductor laser. The exposure device 3 outputs laser light (beam) L modulated correspondingly to an image signal input from a host processing device such as an image reading device (not shown) and subjects the uniformly charged surface of the photosensitive drum 1 to scanning exposure to the light L depending on image information. In this embodiment, the exposure device 3 subjects an image portion of the image information to the scanning exposure. With respect to the rotational direction of the photosensitive drum 1, a position where the surface of the photosensitive drum 1 is subjected to the scanning exposure by the exposure device 3 in an exposure portion (exposure position) b. An absolute value of the potential of the surface of the photosensitive drum 1 at a portion which has been irradiated with the laser light L lowers, so that an electrostatic latent image (electrostatic image) is successively formed on the photosensitive drum 1 surface correspondingly to the image information. The developing device 4 is a developing device of a two-component magnetic brush developing type in this embodiment and supplies a toner of a two-component developer to the photosensitive drum 1 surface to develop (visualize) the electrostatic latent image on the photosensitive drum 1 into a toner image. The developing device 4 includes a developing container 4*a*, a non-magnetic developing sleeve 4*b* as a developer carrying member which is provided at an opening of the developing container 4*a*, and a fixed magnet roller 4*c* contained in the developing sleeve 4*b*. A two-component developer 4*e* which is a mixture of non-magnetic toner particles (toner) and magnetic carrier particles (carrier) is accommodated in the developing container 4*a*. The developing sleeve 4*b* carries and feeds the developer 4*e*. The developer 4*e* carried on the developing sleeve 4*b* is regulated by a regulating blade 4*d* and is coated on the developing sleeve 4*b* in a thin layer, and then is fed to a developing portion (developing position) c where the photosensitive drum 1 and the developing sleeve 4*b* oppose each other. At the developing portion c, the developer 4*e* on the developing sleeve 4*b* is erected to form a magnetic brush 4*h*, and contacts the surface of the photosensitive drum 1. The developer 4*e* in the developing container 4*a* is fed toward the developing sleeve 4*b* while being stirred uniformly by rotation of two developer-stirring members 4*f*. In this embodiment, the carrier has a volume resistivity of about $10^{13}$ ohm·cm and a particle size of 40 μm. The toner is triboelectrically charged to a negative polarity by friction with the carrier. The toner content (concentration) in the toner container 4*a* is detected by a concentration (density) sensor (not shown). On the basis of this detected information, the toner is supplied in an appropriate amount from a toner hopper 4*g* to the developing container 4*a*, so that the toner content in the developing container 4*a* is adjusted at a constant level.

At the positioning portion c where the developing sleeve 4*b* and the photosensitive drum 1 oppose each other, the closest distance between the developing sleeve 4*b* and the photosensitive drum 1 is kept at 300 μm. The developing sleeve 4*b* is rotationally driven in a direction indicated by an arrow R4 in FIG. 1 so that a surface movement direction thereof is opposite to a surface movement direction of the photosensitive drum 1 at the developing portion c. To the developing sleeve 4*b*, a predetermined developing voltage (developing bias) is applied from a developing voltage source S2 as a developing voltage applying means. In this embodiment, the developing voltage applied to the developing sleeve 4*b* is the oscillating voltage in the form of a DC voltage (Vdc) biased with an AC voltage (Vac). More specifically, in this embodiment, the developing bias voltage is the oscillating voltage in the form of the DC voltage (−320 V) biased with the AC voltage having a peak-to-peak voltage of 1800 Vpp and a frequency of 8 kHz.

In this embodiment, the electrostatic latent image on the photosensitive drum 1 is developed by the developing device 4 through a reverse development process. That is, on an exposed portion (light portion) of the photosensitive drum 1 lowered in absolute value of a potential by exposure after the uniform charging, the toner charged to the same polarity (negative in this embodiment) as the charge polarity of the photosensitive drum 1 is deposited by the developing device 4.

The transfer roller 5 is disposed in contact with the photosensitive drum 1. The transfer roller 5 is urged toward the photosensitive drum 1 by an unshown urging means, and thus is press-contacted to the photosensitive drum 1 with a predetermined urging force. As a result, a transfer portion (transfer nip, transfer position) d is formed at a contact portion between the photosensitive drum 1 and the transfer roller 5. The transfer roller 5 is rotated by rotation of the photosensitive drum 1 in a direction indicated by an arrow R5 in FIG. 1.

To the transfer roller 5, from a transfer voltage source S3 as a transfer voltage applying means, a transfer voltage (transfer bias) which is a DC voltage of an opposite polarity (positive in this embodiment) to the charge polarity (normal charge polarity) of the toner during development is applied. As a result, the toner image on the surface of the photosensitive drum 1 is electrostatically transferred onto a transfer material P such as a recording material (medium) as a toner image receiving member sandwiched and fed between the photosensitive drum 1 and the transfer roller 5 at the transfer portion d.

In this embodiment, between the transfer voltage source S3 and the transfer roller 5, a transfer current measuring circuit ("transfer ammeter") 50 as a current detecting means is provided. As a result, the transfer ammeter 50 can detect a value of a DC current flowing through the transfer roller 5 when the transfer voltage source S3 applies the DC voltage to the transfer roller 5. The transfer ammeter 50 may only be required to measure the DC current value between the photosensitive drum 1 and the transfer roller 5 and therefore may also be provided between the develop 1 and the ground. In this embodiment, the transfer voltage source S3 is constituted so that it can output a constant voltage having a voltage value set by control of a controller 60. The controller 60 changes a set value of the output of the transfer voltage source S3 so that the current value detected by the transfer ammeter 50 is a predetermined value, whereby a voltage supplying a predetermined current can be applied from the transfer voltage source S3 to the transfer roller 5. The controller 60 can obtain pieces of information on the voltage value and the current value from the set value of the output of the transfer voltage source S3 and a detection result of the transfer ammeter 50 at this time, respectively.

The fixing device 6 includes a fixing roller 6*a* and a pressing roller 6*b* which rotate in directions indicated by arrows R6*a* and R6*b*, respectively, in FIG. 1. The fixing device 6 fixes the toner image on the transfer material P under heat and pressure application while sandwiching and feeding the transfer material P at a fixing portion (fixing nip) which is a contact portion between the fixing roller 6*a* and the pressing roller 6*b*.

The cleaning device 7 removes and collects the toner (transfer residual toner), remaining on the surface of the photosensitive drum 1 after the transfer step, from the surface of the photosensitive drum 1. The cleaning device 7 scraping off the transfer residual toner from the surface of the photosensitive drum 1 by rubbing the surface of the rotating photosensitive drum 1 with a cleaning blade 7*a* as a cleaning member. With respect to the rotational direction of the photosensitive drum 1, a contact portion between the photosensitive drum 1 and the cleaning blade 7*a* is a cleaning portion (cleaning position) e.

2. Operation Sequence

Figure 3:
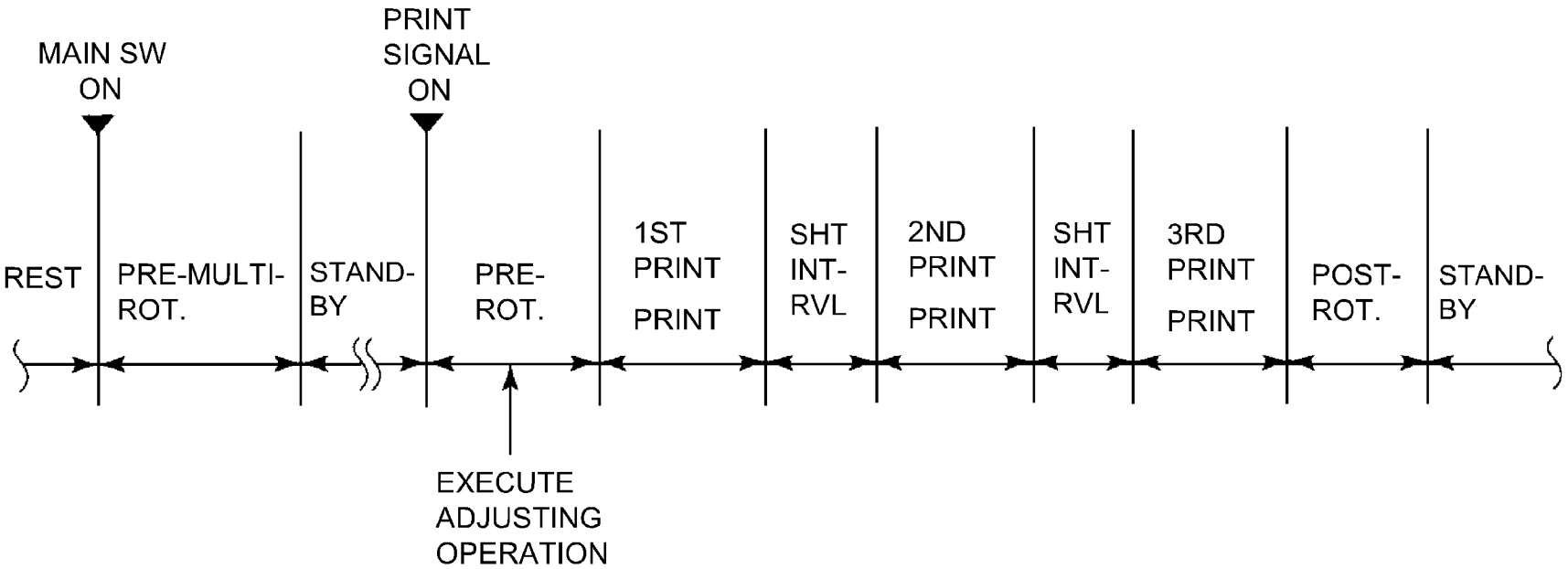
FIG. 3 is a diagram showing an operation sequence of the image forming apparatus.

FIG. 3 shows an operation sequence of the image forming apparatus 100.

a. Initial Rotation Operation (Pre-Multi-Rotation Step)

An initial rotation operation is performed in a preparatory operation period (starting operation period, actuation operation period, warming period) during actuation of the image forming apparatus 100. In the initial rotation operation, the photosensitive drum 1 is rotationally driven by turning on a main (power) switch of the image forming apparatus 100 and a preparatory operation of a predetermined process device, such as rising of the fixing device 6 to a predetermined temperature is executed.

b. Print-Preparatory Rotation Operation (Pre-Rotation Step)

A print-preparatory rotation operation is performed in a preparatory operation period from an input of a print signal (an image output operation start signal) into the image forming apparatus 100 until a printing step is actually started. When the print signal is inputted during the initial rotation operation, the print-preparatory rotation operation is executed subsequently to the initial rotation operation. When there is no input of the print signal, the drive of a main motor is once stopped after the end of the initial rotation operation and the rotational drive of the photosensitive drum 1 is stopped, so that the image forming apparatus 100 is maintained in a stand-by state until a subsequent print signal is inputted. Then, when the print signal is inputted, the print-preparatory rotation operation is executed.

c. Printing Step (Image Forming Operation)

A printing step is performed in a period in which the toner image formation of the photosensitive drum 1, the toner image transfer onto the transfer material P, the toner image fixing on the transfer material P and the like are actually executed. Specifically, timing of the printing step differs at each of positions where the steps of the charging, the exposure, the development, the transfer and the fixing are executed. In the case of an operation in a continuous printing mode, the above-described printing step is repetitively formed correspondingly to a predetermined set print number n (n=3 in the case of FIG. 3).

d. Sheet-Interval Step

A sheet-interval step is performed in a period corresponding to a period, in which there is no transfer material P at the transfer position, from after passing of a trailing end of a transfer material P until a leading end of a subsequent transfer material P reaches the transfer position.

e. Post-Rotation Step

A post-rotation step is performed is a period in which the photosensitive drum 1 is rotationally driven by continuing the drive of the main motor for some time even after the printing step for a final transfer material P is ended, and thus a predetermined post-operation is executed.

f. Stand-By Step

When the predetermined post-operation is ended, the drive of the main motor is stopped and thus the rotational drive of the photosensitive drum 1 is stopped, so that the image forming apparatus 100 is maintained in a stand-by state until a subsequent print signal is inputted. In the case of printing of a single sheet, after the end of the printing, the image forming apparatus 100 is in the stand-by state through the post-rotation step. In the stand-by state, when the print signal is inputted, the operation of the image forming apparatus 100 shifts to the print-preparatory rotation operation.

The printing step c described above is performed during image formation, and the initial rotation step a, the print-preparatory step b, the sheet-interval step d and the post-rotation step e which are described above are performed during non-image formation. A series of operations including the above-described print-preparatory rotation operation and operations in the printing step, the sheet-interval step, the post-rotation step and the like is also referred to as an image outputting operation (job).

In this embodiment, in the print-preparatory rotation operation, an adjusting operation for adjusting the transfer voltage during subsequent image formation is executed.

3. Control Manner

In this embodiment, the controller 60 as a control means provided in the image forming apparatus 100 effects general control of the image forming apparatus 100. The controller 60 is constituted by including CPU which is a central element performing computation and memories such as ROM and RAM which are storing elements, and the like. In the RAM, a detection result of a sensor, a computation result, and the like and stored, and in the ROM, a control program, a data table obtained in advance, and the like are stored. With the controller 60, objects to be controlled in the image forming apparatus 100 are connected. Particularly, in this embodiment, with the controller 60, the charging voltage source S1, the transfer voltage source S3, the charging ammeter 50 and the transfer ammeter 50 are connected, and the controller 60 executes an adjusting operation for adjusting the transfer voltage. At that time, as described later specifically, the controller controls a voltage applied from the charging voltage source S1 to the charging roller 2 and a voltage applied from the transfer voltage source S3 to the transfer roller 5 using detection results of the charging ammeter 40 and the transfer ammeter 50, respectively.

4. Adjusting Operation

The adjusting operation of the transfer voltage in this embodiment will be described. In this embodiment, in the pre-rotation step, the adjusting operation is performed, every job, for determining a target voltage value of the transfer voltage during image formation in the job. The adjusting operation is basically constituted by the ATVC described above. That is, in the pre-rotation step, when there is no transfer material P at the transfer portion d, the voltage subjected to constant current control at a predetermined target current value (first target current value) is applied from the transfer voltage source S3 to the transfer roller 5. Then, on the basis of a value of a voltage generated at that time, a target voltage value (first target voltage value) of the transfer voltage to be applied from the transfer voltage source S3 to the transfer roller 5 through the constant voltage control during the image formation is obtained. As described above, in this embodiment, the controller 60 can obtain the pieces of information on the voltage value and the current value from the set value of the output of the transfer voltage source S3 and the detection result of the transfer ammeter 50, respectively.

The target voltage value of the transfer voltage during image formation may be the generated voltage value itself in the adjusting operation and may also be a value induced using a predetermined operational expression set in advance on the basis of the generated voltage value or a look-up table. In this embodiment, the predetermined target current value in the adjusting operation through the constant current control is set by a target value of the transfer current during image formation. Then, the generated voltage value (specifically an average value as described later) in the adjusting operation is determined as the target voltage value of the transfer voltage during image formation.

In this embodiment, in the adjusting operation, the voltage applied from the transfer voltage source S3 to the transfer roller 5 is gradually changed until the current value reaches the predetermined target current value. This is because an excessive voltage due to abrupt voltage rise is suppressed and the like in this embodiment.

However, when the voltage applied to the transfer roller 5 is changed in the adjusting operation as described above the surface potential (pre-charging potential) of the photosensitive drum 1 after passed through the transfer portion d fluctuates as described above, so that also the surface potential (charge potential) of the photosensitive drum 1 after the charging process also fluctuates. Then, in order to adjust the transfer voltage with accuracy, when the photosensitive drum 1 is rotated for a long time for repetitively charging the surface of the photosensitive drum 1 fluctuated in charge potential, it takes much time to perform the adjusting operation.

In this embodiment, in the adjusting operation, the voltage applied to the charging roller 2 is controlled so that the surface potential of the photosensitive drum 1 after the charging process becomes constant even when the voltage applied to the transfer roller 5, whereby it becomes possible to shorten the time required to perform the adjusting operation.

Figure 4:
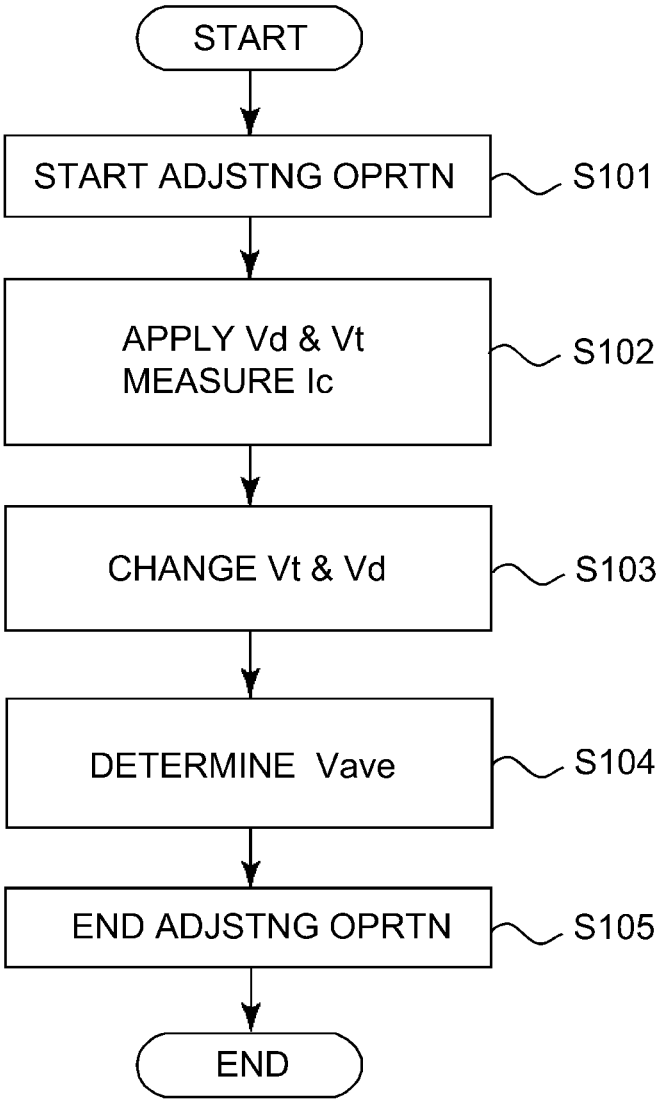
FIG. 4 is a flowchart showing a schematic procedure of an adjusting operation in Embodiment 1.

FIG. 4 is a flowchart showing a schematic procedure of the adjusting operation in this embodiment. This adjusting operation is executed by control by the controller 60.

S101:

In the pre-rotation step, the adjusting operation is started.

S102:

When the adjusting operation is started, the photosensitive drum 1 is charged by applying, from the charging voltage source S1 to the charging roller 2, the charging voltage subjected to the constant voltage control at a predetermined target voltage value (second target voltage value) during image formation. Then, from the transfer voltage source S3 to the transfer roller 5, the transfer voltage subjected to the constant voltage control at the target voltage value (first target voltage value) of the transfer voltage used during the last image formation is applied. Then, when the surface of the photosensitive drum 1 passed through the transfer portion d under application of the transfer voltage to the transfer roller 5 is charged by the charging roller 2 to which the charging voltage is applied, a charging voltage Ic is detected by the charging ammeter 40. The detected charging current Ic is stored in the memory of the controller 60. This charging current Ic is a target current value (second target current value) $Ic_{target}$ when the charging voltage is subjected to the constant current control described later. After the charging current Ic is detected, the rotational drive of the photosensitive drum 1 is continued, and also the application of the charging voltage in the constant voltage control is continued, but the application of the transfer voltage is once stopped.

As in this embodiment, the second target current value may preferably be the following current value. That is, the second target current value is a current value detected by the charging ammeter 40 when the surface of the photosensitive drum 1 passed through the transfer portion d under application of the constant voltage-controlled voltage from the transfer voltage source S3 to the transfer roller 5 is charged by the charging roller 2 to which the constant voltage-controlled voltage is applied from the charging voltage source S1. At this time, the voltage applied to the transfer roller 5 by the transfer voltage source S3 is subjected to the constant voltage control at the first target voltage value. The voltage applied to the charging roller 2 by the charging voltage source S1 is subjected to the constant voltage control at the second target voltage value. The first target voltage value may preferably be a target value of the transfer voltage applied in the constant voltage control during image formation effected before (typically, immediately before) the above-described adjusting operation. The second target voltage value may preferably be a target value of the voltage applied in the constant voltage control from the charging voltage source S1 to the charging roller 2. As a result, the second target current value can be detected under a condition corresponding to the condition during image formation. In this embodiment, this second target current value is detected in the adjusting operation by the charging ammeter 40 before the voltage applied from the transfer voltage source S3 to the transfer roller 5 is changed. That is, in this embodiment, in the adjusting operation, the second target current value used for effecting the constant current control of the charging voltage in the adjusting operation. However, the second target current value is not limited thereto, but may also be a current value detected by the charging ammeter 40 during image formation effected before (typically, immediately before) the adjusting operation. Alternatively, the second target current value detected in a single adjusting operation may also be used in another adjusting operation or in a plurality of other adjusting operations which are performed thereafter.

S103:

Thereafter, transfer voltage application from the transfer voltage source S3 to the transfer roller 5 is started. At this time, the transfer voltage is gradually changed in a control time T1 so that the current value detected by the transfer ammeter 50 is gradually changed from 0 μA toward the target current value (first target current value) $Ic_{target}$. The control time T1 is set appropriately at a time enough to suppress the excessive voltage with the abrupt voltage rise. In this embodiment, during this control time T1, the transfer voltage is linearly increased in absolute value of the current value, with the result that an absolute value of the voltage value is gradually increased.

After a lapse of a time Ta from start of the transfer voltage application until the photosensitive drum 1 moves from the transfer portion d to the charging portion a, the charging voltage applied into the constant voltage control is started to be changed in the following manner. That is, the voltage applied from the charging voltage source S1 to the charging roller 2 is gradually changed in the control time T1 so that the current value detected by the charging ammeter 40 is gradually changed from 0 μA toward the predetermined target current value (second target current value) $Ic_{target}$. This control time T1 is the same length as the control time T1 in which the transfer voltage is gradually changed. In this embodiment, during the control time T1, the charging voltage is linearly increased in absolute value of the current value. The change in voltage value at this time will be described later.

In this embodiment, a distance from the transfer portion d to the charging portion a with respect to the rotational direction of the photosensitive drum 1 along a circumferential direction of the photosensitive drum 1 is about 49 mm. Accordingly, the time (pre-charging movement time) Ta required until the position of the photosensitive drum 1 at the transfer portion d reaches the charging portion a by the rotation of the photosensitive drum 1 is 362 msec. A distance from the charging portion a to the transfer portion d with respect to the rotational direction of the photosensitive drum 1 along the circumferential direction of the photosensitive drum 1 is about 45 mm. Accordingly, a time (pre-transfer movement time) Tb required until the position of the photosensitive drum 1 at the charging portion a reaches the transfer portion d by the rotation of the photosensitive drum 1 is 336 msec.

S104:

When the current value reaches the target current value $Ic_{target}$ after a lapse of the control time T1 from the start of the application of the transfer voltage, the transfer voltage is subjected to the constant current control at the target current value $Ic_{target}$. During execution of the constant current control, an average value of transfer voltage values in a period of a time Tr corresponding to one full circumference of the transfer roller 5 is obtained. That is, in order to average non-uniformity of an electric resistance value of the transfer roller 5 with respect to the circumferential direction, sampling of the transfer voltage value is made over the time corresponding to one full circumference of the transfer roller 5, and then an average value thereof is obtained.

On the other hand, when the current value reaches the target current value $Ic_{target}$ after the lapse of the control time T1 from the start of the gradual change in charging voltage, the charging voltage application is changed to that in the constant voltage control at the predetermined target voltage value during image formation.

Then, the above-described average value Vave is determined as a target voltage value of the transfer voltage to be applied in the constant voltage control during image formation.

S105:

As described above, the adjusting operation in the pre-rotation step is ended. Thereafter, when the predetermined pre-rotation step is ended, the transfer voltage is applied in the constant voltage control using the above-described average value Vave as the target voltage value, so that the image forming step is started.

In this embodiment, values of respective parameters were as follows.

Vd=−700 V $I_{target}$=20 μA $Ic_{target}$=−20 μA

Ta=362 msec (pre-charging movement time)

Tb=336 msec (pre-transfer movement time)

T1=500 msec

Tr=372 msec (one full circumference rotation time of transfer roller of 16 mm in diameter)

Figure 5:
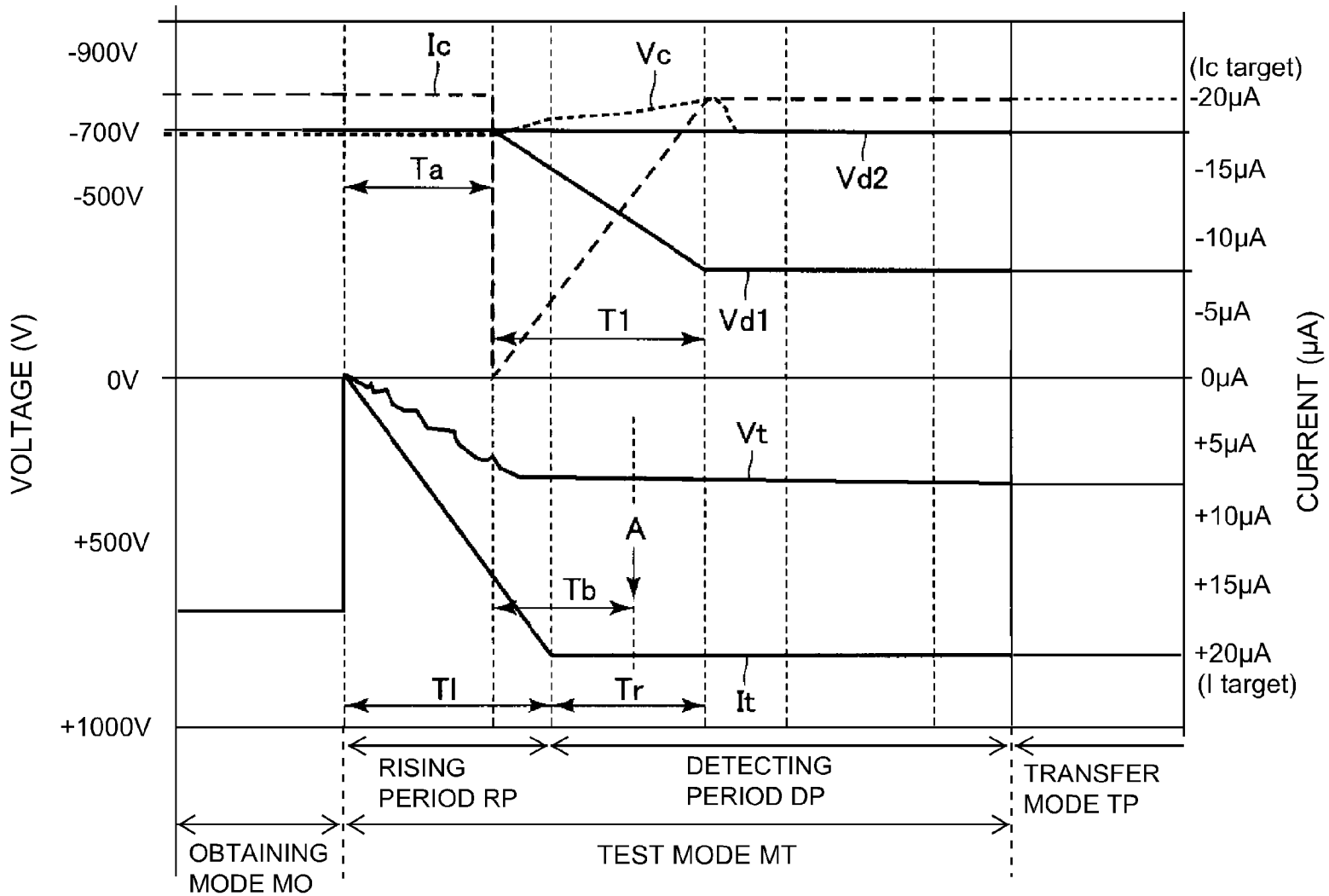
FIG. 5 is a graph showing a potential relationship in Embodiment 1.

FIG. 5 is a graph showing progression of the surface potential of the photosensitive drum 1, progression of a voltage value and a current value of the charging voltage, and progression of a voltage value and a current value of the transfer voltage in the adjusting operation in this embodiment. In FIG. 5, Vd1 shows a measurement result of the progression of the surface potential of the photosensitive drum 1 after passing through the transfer portion d and before reaching the charging portion a. Vd2 shows a measurement result of the progression of the surface potential of the photosensitive drum 1 after passing through the charging portion a and before reaching the transfer portion d. Vc shows a measurement result of the progression of the voltage value of the charging voltage. Ic shows a measurement result of the progression of the current value of the charging voltage. Further, Vt shows a measurement result of the progression of the voltage value of the transfer voltage. Further, It shows a measurement result of the progression of the current value of the transfer voltage. Incidentally, with respect to Vc, no scale is provided, and only a tendency of the change is shown.

In the step S102, the surface potential of the photosensitive drum 1 is stable at Vd1=−700 V and Vd2=−700 V.

Then, in the step S103, the current value It is changed from 0 μA to 20 μA, so that the transfer voltage value Vt fluctuates from 0 V to 300 V. On the other hand, after the lapse of the time Ta from the start of the transfer voltage application Vd1 fluctuates from −700 V to −300 V depending on the change in transfer voltage, but Ic is changed from 0 μA to 20 μA, and therefore Vd2 is stable at −700 V. At this time, Vc fluctuates so that the absolute value thereof becomes larger than the voltage during the constant voltage control in such a manner that Vc components for insufficient supply of electric charges as generated in Comparison Example described later.

In the step S103, the transfer voltage is subjected to the constant voltage control so that It becomes constant at 20 μA after a lapse of the control time, T1 from start of the application of the transfer voltage, and thus Vt is stable at −300 V. Then, the average value Vave of the voltage value of the transfer voltage during the time Tr is obtained in this state, so that the average value Vave is determined as a target voltage value of the transfer voltage during image formation. On the other hand, in the step S103, after a lapse of the control time T1 from start of change in charging voltage the control of the application of the charging voltage is changed to the constant voltage control, so that Vd1 is stable at −300 V, and Vd2 is stable at −700 V.

Here, the position of the photosensitive drum 1 located at the charging portion a when the change in charging voltage is stated reaches the transfer portion d after the above-described pre-transfer movement time Tb (a point of time indicated by an arrow A in FIG. 5). Accordingly, a period in which the surface of the photosensitive drum 1 passed through the charging portion a when the charging voltage is changed passes through the transfer portion d and a period of the time Tr in which the average value Vave of the voltage value of the transfer voltage at least partly overlap with each other. In this embodiment, of the period of the time Tr, a period after the point of time indicated by the arrow A overlaps with the period in which the surface of the photosensitive drum 1 passed through the charging portion a when the charging voltage is changed.

In this way, in the adjusting operation in this embodiment, the fluctuation in surface potential of the photosensitive drum 1 after the charging process with the change in transfer voltage does not generate or is small to the degree that the fluctuation is negligible. That is, at the transfer portion d, electric discharge generates between the photosensitive drum 1 and the transfer roller 5, so that positive electric charges are supplied from the transfer roller 5 to the photosensitive drum 1. As a result, the surface potential Vd1 after passed through the transfer portion d and before reaching the charging portion a abruptly fluctuates during the control time T1. However, the electric charges are supplied in a necessary amount to the photosensitive drum 1 by gradually changing the charging current Ic correspondingly to the fluctuation in Vd1, so that the surface potential Vd2 of the photosensitive drum 1 after passed through the charging portion a and before reaching the transfer portion d can be made constant without being fluctuated. Accordingly, it is possible to determine the target voltage value of the transfer voltage during image formation using the information on the voltage value and the current value of the transfer voltage obtained in the period which at least partly overlaps with the period in which the surface of the photosensitive drum 1 passed through the charging portion a when the charging voltage is changed passes through the transfer portion d. As a result, the time required to perform the adjusting operation can be shortened. This effect can be obtained if the period in which the surface of the photosensitive drum 1 passed through the charging portion when the charging voltage is changed passes through the transfer portion d and the period in which the information on the voltage value and the current value of the transfer voltage is obtained at least partly overlap with each other. However, these periods may also be completely coincide with each other or in a state in which one period is included in the other period.

In summary, according to this embodiment, as shown in FIG. 5, in an operation in an obtaining mode ("OM"), the current detected by the second detecting portion during passing of a region of the photosensitive member through the charging portion after the region of the photosensitive member passed through the charging portion and the transfer portion when a predetermined charging voltage is applied to the charging member and a predetermined transfer current is caused to flow through the transfer member is obtained as an obtained charging current ("$IC_{target}$") in a period preceding to a transfer period ("TP") in which the toner image is transferred at the transfer portion. In an operation in a test mode ("TM"), in a detecting period ("DP") after the operation in the obtaining mode ("OM") and in the period preceding to the transfer period ("TP"), a voltage applied to the transfer member in the transfer period ("TP") is set on the basis of a detection result of the first detecting portion when the transfer voltage source causes the predetermined transfer current to flow through the transfer member.

In the operation in the test mode ("TM"), the executing portion gradually changes a value of the current caused to flow through the transfer member from zero to a predetermined target transfer current ("$I_{target}$") in a rising period preceding to the detecting period and sets the current caused to flow through the transfer member as the predetermined target transfer current ("$I_{target}$") in the detecting period and, and then gradually changes the current caused to flow through the charging member from zero to the obtained charging current ("$IC_{target}$") when a region of the photosensitive member positioned at the transfer portion in the rising period ("RP") subsequently passes through the charging portion and sets the current caused to flow through the charging member when a region of the photosensitive member positioned at the transfer portion in the detecting period subsequently passes through the charging portion as the obtained charging current ("$IC_{target}$").

5. Comparison Example

Comparison Example in which the control for changing the charging voltage in the adjusting operation is not effected will be described.

Figure 6:
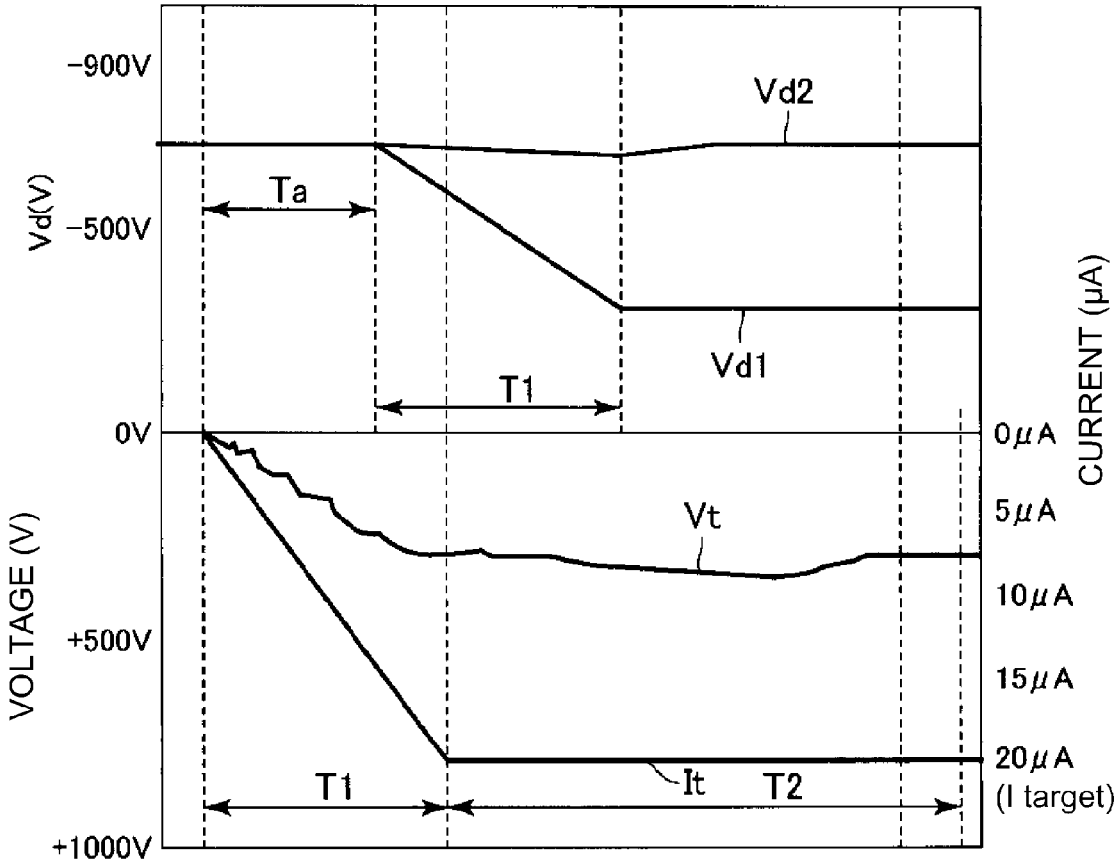
FIG. 6 is a graph showing a potential relationship in Comparison Example.
Figure 7:
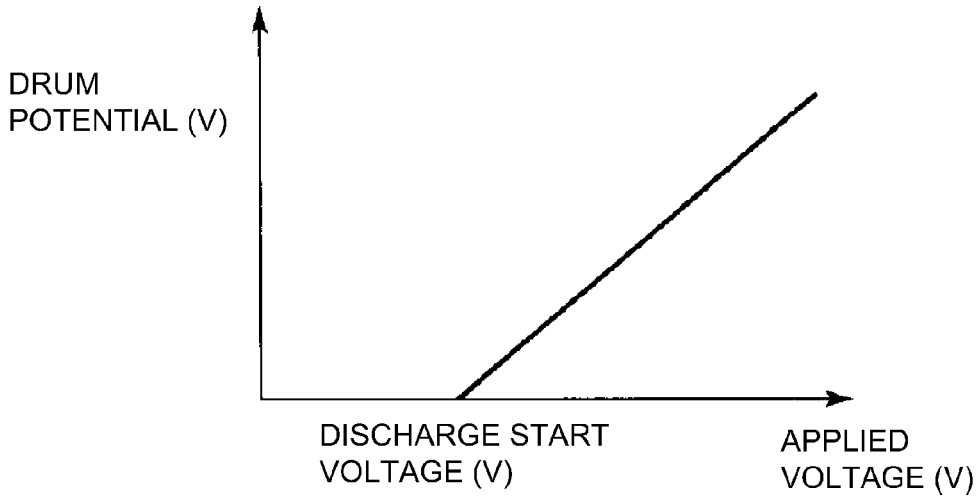
FIG. 7 is a graph showing a relationship between an applied voltage and a photosensitive member potential in a DC charging type.

FIG. 6 shows progression of a surface potential of the photosensitive drum 1 in an adjusting operation in Comparison Example and progression of a voltage value and a current value of a transfer voltage in Comparison Example. In FIG. 5, Vd1, Vd2, Vt and It are similar to those in FIG. 5. When the adjusting operation is started, the photosensitive drum 1 is charged by applying, from the charging voltage source S1 to the charging roller 2, the charging voltage subjected to the constant voltage control at a predetermined target voltage value during image formation.

Thereafter, transfer voltage application from the transfer voltage source S3 to the transfer roller 5 is started. At this time, the transfer voltage is gradually changed in a control time T1 so that the current value detected by the transfer ammeter 50 is gradually changed from 0 μA toward the target current value $Ic_{target}$.

Here, in Comparison Example even after a lapse of a time Ta from start of the transfer voltage application until the photosensitive drum 1 moves from the transfer portion d to the charging portion a, a charging voltage Vd is continuously applied into the constant voltage control.

When the current value reaches the target current value $Ic_{target}$ after a lapse of the control time T1 from the start of the application of the transfer voltage, the transfer voltage is subjected to the constant current control at the target current value $Ic_{target}$. This state in which the constant current control is effected is maintained for a stable time T2. Then, after a lapse of the stable time T2, an average value of transfer voltage values in a period of a time Tr corresponding to one full circumference of the transfer roller 5 is obtained.

Then, the above-described average value Vave is determined as a target voltage value of the transfer voltage to be applied in the constant voltage control during image formation.

Thereafter, when the predetermined pre-rotation step is ended, the transfer voltage is applied in the constant voltage control using the above-described average value Vave as the target voltage value, so that the image forming step is started.

In this Comparison Example, values of respective parameters were as follows.

Vd=−700 V $I_{target}$=20 μA

Ta=362 msec (pre-charging movement time)

Tb=336 msec (pre-transfer movement time)

T1=500 msec

T2=1060 msec ((one full circumference rotation time of photosensitive drum of 30 mm in diameter)+(passing time from transfer portion to charging portion))

Tr=372 msec (one full circumference rotation time of transfer roller of 16 mm in diameter)

As is understood from FIG. 6, in Comparison Example, after a lapse of the time Ta, depending on the change in transfer voltage, Vd1 fluctuates from −700 V to −300 V and at this time, also Vd2 fluctuates from −700 V to −670 V. Then, the constant current control is effected after a lapse of the control time T1 from start of the application of the transfer voltage so that It is constant at 20 μA, but at this time Vt fluctuates from 300 V to 330 V. Thereafter, when the stable time T2 elapses, Vt is stable at 300 V. On the other hand, Vd1 is stable at −300 V after the lapse of the control time T1 from start of the change, but Vd2 fluctuates from −670 V toward −700 V even after Vd1 is stable, and then is stable at −700 V.

In this way, in the adjusting operation in Comparison Example, the surface potential of the photosensitive drum 1 after the charging process fluctuates with the change in transfer voltage. That is, at the transfer portion d, electric discharge generates between the photosensitive drum 1 and the transfer roller 5, so that positive electric charges are supplied from the transfer roller 5 to the photosensitive drum 1. As a result, the surface potential Vd1 after passed through the transfer portion d and before reaching the charging portion a abruptly fluctuates during the control time T1. Further, in Comparison Example, the charging voltage is subjected to the constant voltage control also during the control time T1, and therefore with the fluctuation in Vd1, also Vd2 fluctuates by about 30 V. This is because the supply of the electric charges is not in time for the fluctuation in potential of Vd1, and thus Vd2 becomes unstable. As a result, when the region of the photosensitive drum 1 in which Vd2 fluctuates passes through the transfer portion d, the fluctuation of about 30 V generates in the transfer voltage. This is because a contract between the transfer voltage and the surface potential of the photosensitive drum 1 at the transfer portion d fluctuates.

When the target voltage values of the transfer voltage during image formation is determined using a value of Vt fluctuating in this way (i.e., when Vave is obtained), accuracy of adjustment of the transfer voltage lowers, so that accurate setting of the transfer voltage cannot be made. For that reason, there is a need to cause the region of the photosensitive drum 1 where Vd2 fluctuates to flow through the charging portion a again to stabilize the surface potential of the photosensitive drum 1 after the charging process. Accordingly, in Comparison Example, there is a need to obtain Vave after the image forming apparatus is in stand-by for the stable time T2 after a lapse of the control time T1 from the start of the transfer voltage application, so that a time required for performing the adjusting operation correspondingly thereto.

As described above, the image forming apparatus 100 in this embodiment includes the controller 60 for effecting control of the adjusting operation for adjusting the value of the transfer voltage applied, for the transfer, from the transfer voltage source S3 to the transfer roller 5 by obtaining the information on the voltage value and the current value when the transfer voltage source S3 applies the voltage to the transfer roller 5. In the adjusting operation, the controller 60 charges the surface of the photosensitive drum 1 passed through the transfer portion d during the change in voltage applied from the transfer voltage source S3 to the transfer roller 5 by changing the voltage applied from the charging voltage source S1 to the charging roller 2 so as to suppress the potential fluctuation after the charging process. In addition, the controller 60 adjusts the value of the transfer voltage during image formation on the basis of the above-described information obtained in the period including the period in which the charged surface of the photosensitive drum 1 subsequently passes through the transfer portion d. Particularly, in this embodiment, in the adjusting operation, the controller 60 changes the voltage applied from the transfer voltage source S3 to the transfer roller 5 so that the current value gradually changes toward the first target current value. The controller 60 charges the surface of the photosensitive drum 1 passed through the transfer portion d during the change by changing the voltage applied from the charging voltage source S1 to the charging roller 2 so that the current value gradually changes toward the second target current value. Further, the controller 60 adjusts the value of the transfer voltage during image formation on the basis of the information obtained in the period including the period in which the changed surface of the photosensitive drum 1 subsequently passes through the transfer portion d. Specifically, the controller 60 obtains the information during an operation in which the voltage applied from the transfer voltage source S3 to the transfer roller 5 is subjected to the constant current control so that the current value is constant at the first target current value described above. Here, the first target current value is typically a target value for the transfer.

As described above, according to this embodiment, there is no need to provide the stable (stabilizing) time T2 in Comparison Example, so that it becomes possible to shorten the time for performing the adjusting operation.

Other Embodiments

The present invention was described above based on the specific embodiment, but is not limited thereto.

In the above-described embodiment, the adjusting operation was described as being executed every job in the one-rotation step, but the present invention is not limited thereto. The adjusting operation is not executed in the pre-rotation step in each job, but may also be executed in the pre-rotation step every plurality of jobs. Further, the adjusting operation is not limited to the adjusting operation executed in the pre-rotation step, but can also be executed at arbitrary timing if the timing is during non-image formation such as the sheet interval step or the post-rotation step.

In the above-described embodiment, in the adjusting operation, the target value (target voltage value) during image formation was determined on the basis of the voltage value generated when the voltage subjected to the constant current control is applied. However, the present invention is not limited thereto, but the information relating to the electrical resistance at the transfer portion may only be required to be obtained, and therefore the target value of the transfer voltage may also be determined on the basis of a value of a current supplied when the voltage subjected to the constant voltage control is applied. Such an embodiment is applicable to, e.g., the case where the transfer voltage is subjected to the constant current control during image formation and then the target current value of the transfer voltage is obtained. Also in this case, the surface of the photosensitive drum affected by the transfer voltage to be variably controlled in the adjusting operation is charged by the variably controlled charging voltage. Then, the transfer voltage during image formation may only be required to be determined from the information on the voltage value and the current value of the transfer voltage obtained in the period which at least partly overlaps with the period in which the thus charged surface of the photosensitive drum passed again through the transfer portion.

In the above-described embodiment, in the region ranging from the transfer portion to the charging portion with respect to the rotational direction of the photosensitive member, as the charge-removing means for removing at least a part of the electric charges on the photosensitive member, a pre-exposure device for irradiating the photosensitive member with light (charge-removing light) or the like means was not provided. However, the present invention is not limited thereto, but such a charge-removing means may also be provided. Also in this instance, in the case where the charge-removing means is not operated or in the case where the fluctuation in transfer voltage has the influence on the surface of the photosensitive member after the charging process even when the charge-removing means is operated, it is possible to obtain a similar effect to the effect in the above-described embodiment by applying the control similar to the above-described embodiment.

In the above-described embodiment, in the adjusting operation, the control in which the charging voltage is changed using, as the target current value, the current value detected by the charging current detecting circuit was effected. As a result, it becomes possible to effect the control with high accuracy in conformity with the structure and the status of the image forming apparatus. However, if the current value of the charging voltage can be changed so that the fluctuation, in surface potential of the photosensitive member after the charging process, generating due to the fluctuation in transfer voltage is suppressed, the target value is not limited to the value detected in the image forming apparatus, but may also be a value set in advance.

The present invention can be carried out irrespective of types such as tandem type/one drum type and intermediary transfer type/transfer material feeding type if the image forming apparatus is of a type in which the toner image is electrostatically transferred from the photosensitive member onto the toner image receiving member. As is well known by the person ordinarily skilled in the art, in the tandem type, a plurality of photosensitive members are disposed along, as the toner image receiving member, a feeding direction of the intermediary transfer member or the transfer material carried on the transfer material carrying member, and the toner images are successively transferred superposedly from the photosensitive members onto the toner image receiving member. In this case, with respect to the transfer portion of the toner image from each of the photosensitive members onto the toner image receiving member, the control similar to the control in the above-described embodiment may only be required to be applied. Further, as is well known by the person ordinarily skilled in the art, in the one drum type, the toner image is repetitively formed on a single photosensitive member, and the resultant toner images are successively transferred superposedly onto, as the toner image receiving member, the intermediary transfer member or the transfer material carried on the transfer material carrying member.

While the invention has been described with reference to the structures disclosed herein, it is not confined to the details set forth and this application is intended to cover such modifications or changes as may come within the purpose of the improvements or the scope of the following claims.

This application claims the benefit of Japanese Patent Application No. 2014-186405 filed on Sep. 12, 2014, which is hereby incorporated by reference herein in its entirety.

What is claimed is:

1. An image forming apparatus comprising:

a rotatable photosensitive member;

a charging member for electrically charging a surface of said photosensitive member;

a charging voltage source for applying a charging voltage which is only a DC voltage to said charging member;

an exposure device for exposing the charged surface of said photosensitive member to light to form an electrostatic image;

a developing device for visualizing the electrostatic image as a toner image by supplying a toner to said photosensitive member;

a transfer member for transferring the toner image from said photosensitive member onto a toner image receiving member at a transfer portion;

a transfer voltage source for applying a transfer voltage to said transfer member;

a first detecting portion for detecting a voltage of said transfer voltage source when said transfer voltage source causes a current to flow through said transfer member;

a second detecting portion for detecting a current flowing through said charging member when said charging voltage source applies a voltage to said charging member; and an executing portion for executing an operation in an obtaining mode and expecting an operation in a test mode in a listed order before a transfer period in which the toner image is transferred at the transfer portion, said test mode including a rising period and a detecting period, wherein in the operation in the obtaining mode, an obtained charging current is obtained by detecting a current by said second detecting portion during passing of a region of said photosensitive member through the charging portion after the region of said photosensitive member passed through the charging portion and the transfer portion when a predetermined charging voltage is applied to said charging member and a voltage before adjustment is applied to said transfer member, a voltage applied to said transfer member in the transfer period being adjusted on the basis of a detection result of said first detecting portion when said transfer voltage source causes a predetermined target transfer current to flow through said transfer member in the detecting period, and said executing portion gradually changes a value of the current caused to flow through said transfer member from zero to the predetermined target transfer current in the rising period preceding to the detecting period and sets the current caused to flow through said transfer member as the predetermined target transfer current in the detecting period and then gradually changes the current caused to flow through said charging member from zero to the obtained charging current when a region of said photosensitive member positioned at the transfer portion in the rising period subsequently passes through the charging portion and sets the current caused to flow through said charging member when a region of said photosensitive member positioned at the transfer portion in the detecting period subsequently passes through the charging portion as the obtained charging current.

2. An image forming apparatus according to claim 1, wherein in the operation of the test mode, said executing portion sets a timewise change rate of the current caused to flow through said transfer member in the rising period and a timewise change rate of the current caused to flow through said charging member in the rising period so as to be substantially the same.

3. An image forming apparatus according to claim 2, in the operation in the test mode, said executing portion sets a timewise change rate of the current caused to flow through said transfer member in the rising period and a timewise change rate of the current caused to flow through said charging member in the rising period so as to be a certain value.

4. An image forming apparatus according to claim 1, in the operation in the test mode, the rising period is a time longer than a time in which overshooting of said transfer voltage source with an increase in voltage is suppressed.

5. An image forming apparatus according to claim 1, further comprising a storage unit that stores the obtained charging current obtained in the operation in the obtaining mode, wherein said executing portion executes the operation in the test mode on the basis information from said storage unit.

* * * * *